US005285811A

United States Patent [19]

DiLuigi et al.

[11] Patent Number: 5,285,811

[45] Date of Patent: Feb. 15, 1994

[54] HOPPER GATE VALVE

[75] Inventors: Michael W. DiLuigi; Terry W. Malone, both of Asheville, N.C.

[73] Assignee: Trinity Industries, Inc., Dallas, Tex.

[21] Appl. No.: 915,001

[22] Filed: Jul. 16, 1992

[51] Int. Cl.[5] ..... A01M 7/00

[52] U.S. Cl. ..... 137/347; 251/111; 251/144; 251/229; 251/279

[58] Field of Search ..... 251/229, 279, 144, 90, 251/111, 300, 89.5; 137/347

[56] References Cited

U.S. PATENT DOCUMENTS

| | | | |
|---|---|---|---|
| 713,622 | 11/1902 | Enyart . | |
| 1,171,980 | 2/1916 | Rogers . | |
| 1,749,119 | 3/1930 | Wilson | 251/144 |
| 2,710,017 | 6/1955 | Carter | 137/246.11 |
| 2,912,215 | 11/1959 | Forrester | 251/13 |
| 3,047,024 | 7/1962 | Schuller | 251/279 |
| 3,082,700 | 3/1963 | Dorey | 251/279 |
| 3,185,437 | 5/1965 | Hauser | 251/229 |
| 3,241,730 | 3/1966 | Dorey | 251/279 |
| 3,693,846 | 9/1972 | Schuller | 251/90 |
| 3,812,980 | 5/1974 | Kolb et al. | 251/289 |
| 3,828,808 | 8/1974 | Ortelli | 137/340 |
| 3,912,134 | 10/1975 | Poran | 251/144 |
| 4,027,921 | 6/1977 | Adler et al. | 302/52 |
| 4,077,552 | 3/1978 | Lothmann | 251/144 |
| 4,250,987 | 2/1981 | Trammell et al. | 198/530 |
| 4,317,532 | 3/1982 | Przybylinski | 222/505 |
| 5,000,212 | 3/1991 | Tervo | 137/1 |

FOREIGN PATENT DOCUMENTS

| | | | |
|---|---|---|---|
| 553807 | 3/1958 | Canada . | |
| 53714 | 9/1937 | Denmark | 251/228 |

*Primary Examiner*—A. Michael Chambers
*Attorney, Agent, or Firm*—Baker & Botts

[57] ABSTRACT

An hopper gate valve having a valve body for connection to a hopper car with a generally elongated discharge opening is provided. A valve member is adapted to engageable and disengage the elongated discharge opening by using a control apparatus which controllably and pivotally effects the displacement of the valve member with respect to the elongated discharge opening.

23 Claims, 3 Drawing Sheets

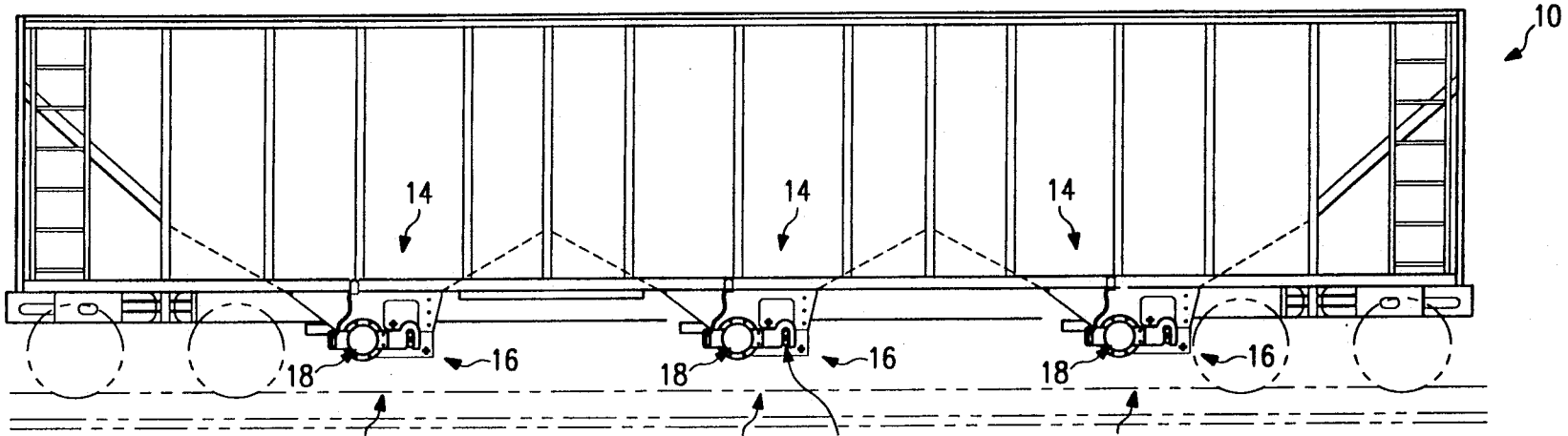
FIG. 1
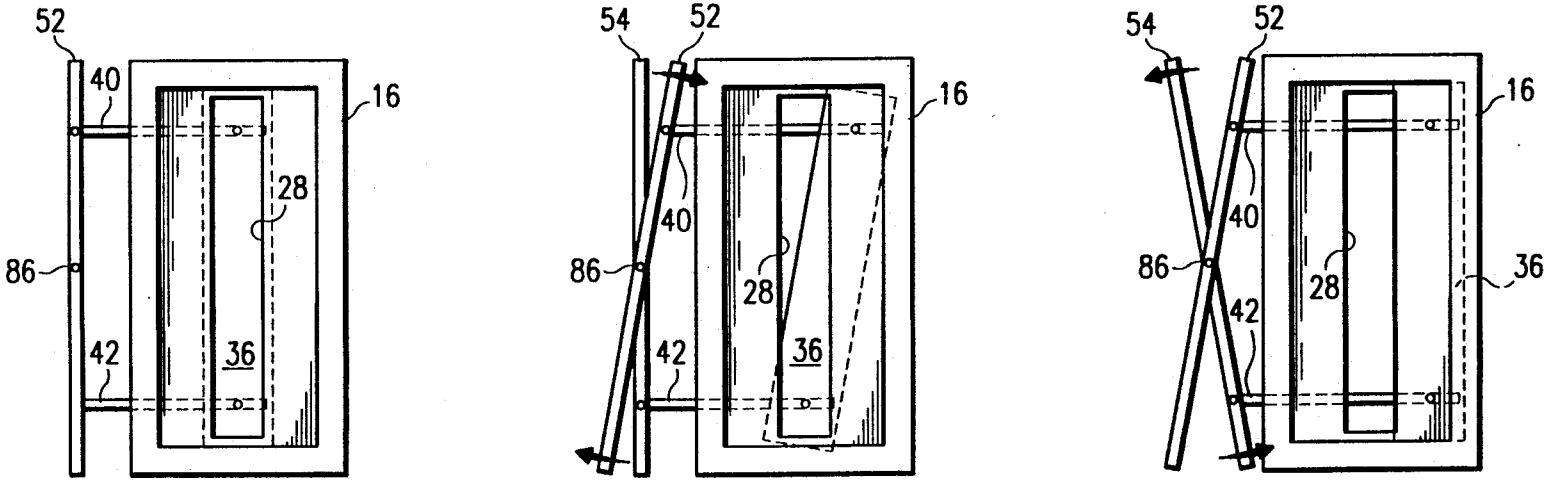
FIG. 7a
FIG. 7b
FIG. 7c

HOPPER GATE VALVE

TECHNICAL FIELD OF THE INVENTION

This invention relates in general to the field of rail hopper cars. More particularly, the present invention relates to a hopper gate valve with an improved control apparatus.

BACKGROUND OF THE INVENTION

In recent years, pneumatic and vacuum systems have been developed for removing the contents of railway hopper cars. Other systems use rack and pinion assembly to open and close the gate valve. Some of these systems have been designed to operate in conjunction with a gate valve that is mounted on the bottom of the hopper and through which the materials are discharged.

These conventional gate valve systems that require complex rack and pinion arrangements, and/or creating a pressure differential and the like, are more difficult to manufacture and employ. Therefore it is highly desirable to construct an easily operable gate valve mechanism with few moving parts and is easy to manufacture. It is also desirable to provide the capability to operate the gate valve from both sides of the hopper car and to provide a variable-sized opening to efficiently discharge the contents of the hopper car.

SUMMARY OF THE INVENTION

In accordance with the present invention, an hopper gate valve is provided which substantially eliminate or reduce disadvantages and problems associated with prior hopper car discharge schemes.

An hopper gate valve having a valve body for connection to a hopper car with a generally elongated discharge opening is provided. A valve member is adapted to engageable and disengage the elongated discharge opening by using a control apparatus which controllably and pivotally effects the displacement of the valve member with respect to the elongated discharge opening.

BRIEF DESCRIPTION OF THE DRAWINGS

For a better understanding of the present invention, reference may be made to the accompanying drawings, in which:

FIG. 1 is an elevational view of a hopper car having discharge gate valves that are constructed in accordance with the invention mounted on the bottom of the hoppers;

Figure 2:
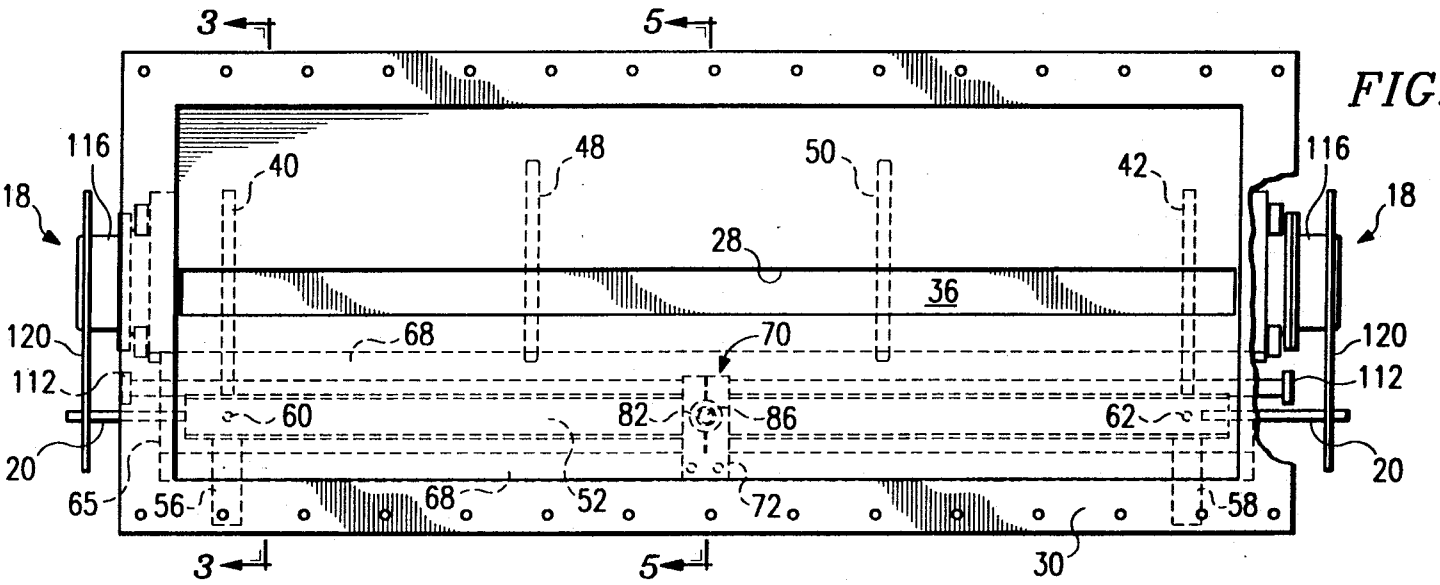
FIG. 2 is a plan view of one of the gate valves removed from the hopper car in FIG. 1.

FIGS. *7a*, *7b* and *7c* are simplified schematic diagrams showing the operating positions of the valve member with respect to the gate valve.

DETAILED DESCRIPTION OF THE INVENTION

With reference to the drawings, FIG. 1 illustrates a preferred embodiment of a hopper car, indicated generally at 10 and constructed according to the teaching of the present invention. Hopper car 10 is outfitted with gate valve control apparatus 12 (three are shown) installed below funnel-like constructions 14 which operate as guides for discharging the material carried in hopper car 10. The discharged material flows through a gate valve 16 and then a closeable discharge opening 18 located at the sides of hopper car 10. The opening and closing of gate valve 16 is achieved by manipulating two operating levers 20 and 22 from either side of hopper car 10. A detailed description of the structure and operation of gate valve control apparatus 12 is provided below with reference to additional drawing figures where like numerals are used to refer to like elements.

Figure 3:
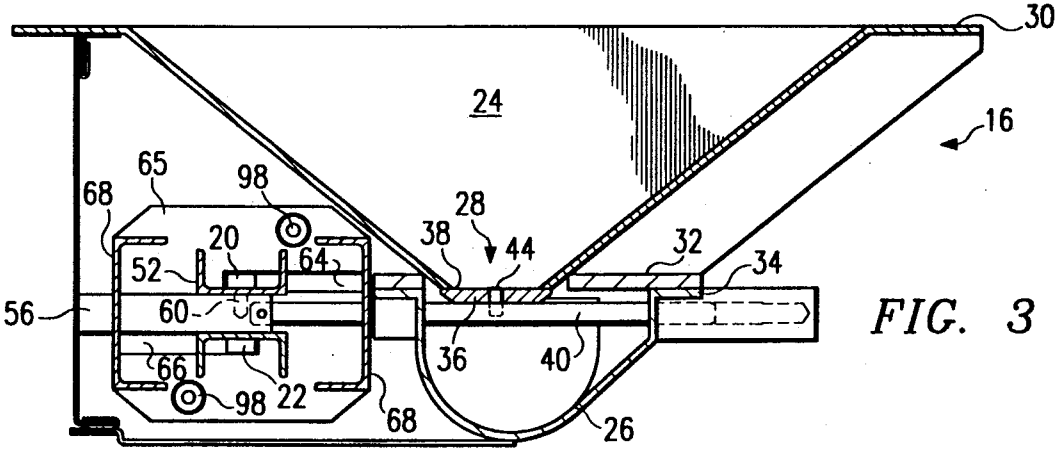
FIG. 3 is a cross-sectional view taken generally along line 3—3 in FIG. 2.

The gate valve control apparatus 12 is illustrated in FIGS. 2 and 3. Gate valve 16 is preferably constructed with a top and bottom portion 24 and 26, respectively, where top portion 24 substantially coincides with funnel construction 14 to further guide the hopper car contents through an elongated flow passageway 28 transversely disposed across hopper car 10. Top portion 24 of gate valve 16 includes a top flange 30 for providing a coupling surface to the lower end of hopper car 10. Top gate valve portion 24 is further connected to bottom gate valve portion 26 by flanges 32 and 34 located on top and bottom gate valve portions 24 and 26, respectively. Although not shown, flanges 32 and 34 are connected in a suitable manner such as by threaded fasteners and the like.

Gate valve 16 further includes a valve member 36 seated in a valve seat 38 constructed at the lower end of flow passageway 28. Valve seat 38 is preferably constructed by machining flange 32 and the lower end of top gate valve portion 24 so that it lies substantially in a single horizontal plane for effective sealing with valve member 36. Flange 32 provides a substantially rigid structural member reinforcing the fabricated top portion 24 to aid in maintaining valve seat 38 in the desired plane.

As illustrated most clearly in FIGS. 2 and 3, valve member 36 is pivotally coupled to a pair of spaced operating rods 40 and 42 by pivot pins 44 and 46, respectively. Valve member 36 is further supported by a pair of spaced support members 48 and 50 extending across valve member 36, as shown in FIG. 2 in phantom lines. The number of support members may vary depending on the application. Operating rods 40 and 42 are further coupled to a top control channel 52 and a bottom control channel 54, respectively, via a pair of connector members 56 and 58, respectively. Although shown as C-channels, top and bottom control channels 52 and 54 may be in the form of any elongated actuating member or rod. Connector members 56 and 58 are pivotally coupled to top and bottom control channels 52 and 58 by pivot pins 60 and 62, respectively.

Therefore, operating lever 20, when moved along a slot 64 defined by an end plate 65, causes top control channel 52 to pivot about a center pivot point 67. This causes connector member 56 to advance accordingly toward valve seat 38, and in turn causes operating rod 40 to pivotally offset the respective end of valve member 36 from valve seat 38. The bottom control channel 54 is similarly manipulatable by moving operating lever 22 along a corresponding slot 66. Lever 22 pivots bottom control channel 54 about center pivot point 67, causing connector member 58 (FIG. 2) to be displaced, which in turn causes the respective end of valve member 36 to be pivotally offset from valve seat 38. It is obvious then when both operating levers 20 and 22 are moved, valve member 36 becomes fully displaced from valve seat 38, thus fully opening flow passageway 28. A pair of elongated support frame channels 68 disposed longitudinally along the length of gate valve 16 are further provided for structural support for gate valve control apparatus 12. The operation of control apparatus 12 is described in more detail below in conjunction with references to FIGS. 7*a* through 7*c*.

Figure 5:
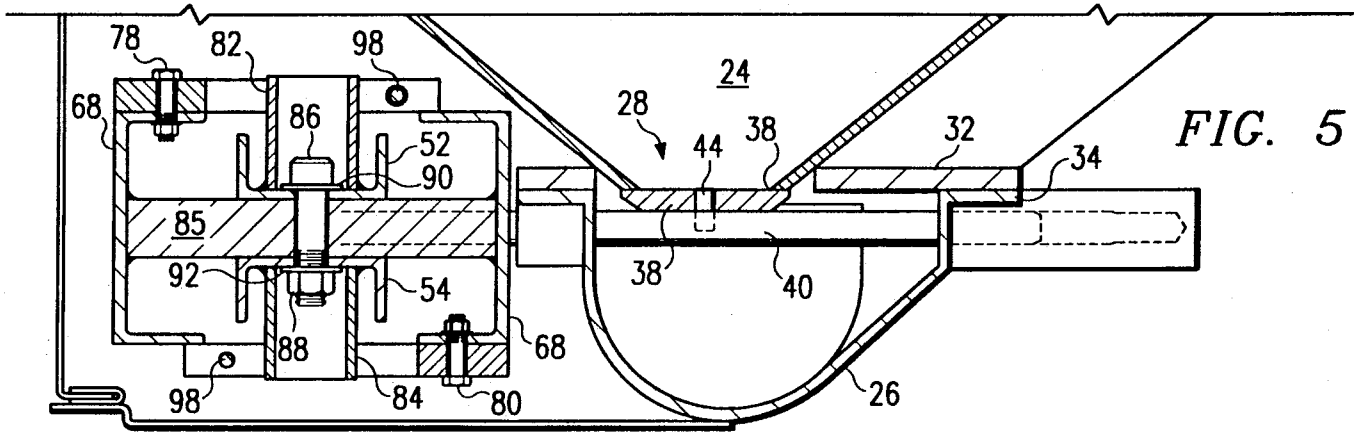
FIG. 5 is a cross-sectional view taken generally along line 5—5 in FIG. 2 showing a preferred embodiment of the friction lock mechanism.

Referring to FIG. 2, a friction lock apparatus 70 is located generally midway along the length of top and bottom control channels 52 and 54, at center pivot point 67. As shown more clearly in FIGS. 4 and 5, friction lock apparatus 70 includes a top and bottom locking member 72 and 74, respectively. Both top and bottom locking members 72 and 74 are bifurcated and shaped somewhat like a fork with two spaced tines or fingers, the base of which are secured to support frame channels 68 by fasteners 76–80. The two tines of each locking member 72 and 74 are preferably separated by an ⅛ inch machined slot. Shown more clearly in FIG. 5 is the manner in which top and bottom locking members 72 and 74 are attached to support frame channels 68. The two tines of each of top and bottom locking members 72 and 74 are shaped to accommodate a generally cylindrical locking collar, where the top locking collar is designated by reference numeral 82 and the bottom locking collar is designated by reference numeral 84. Top and bottom locking collars 82 and 84 are preferably cylindrical and securely fastened to top and bottom control channels 52 and 54 concentrically with respect to center pivot point 67 respectively by welding.

Referring specifically to FIG. 5, top and bottom control channels 52 and 54 are further pivotally secured at center pivot point 67 to one another and to a center plate 85 positioned therebetween. The thickness of center plate 85 is constructed to be slightly greater than that of connector members 56 and 58, so that the spacing between top and bottom control channels 52 and 54 remain substantially constant throughout the length thereof. Center plate 85 is securely fastened to support frame channels 68, preferably by welding. A fastener, such as a bolt 86, including a washer 90 and nut 88, is positioned through aligned holes in top and bottom control channels 52 and 54, and center plate 85. Note that constructed in this manner, fastener 86 effectively serves as the pivot point of both top and bottom control channels 52 and 54.

Figure 4:
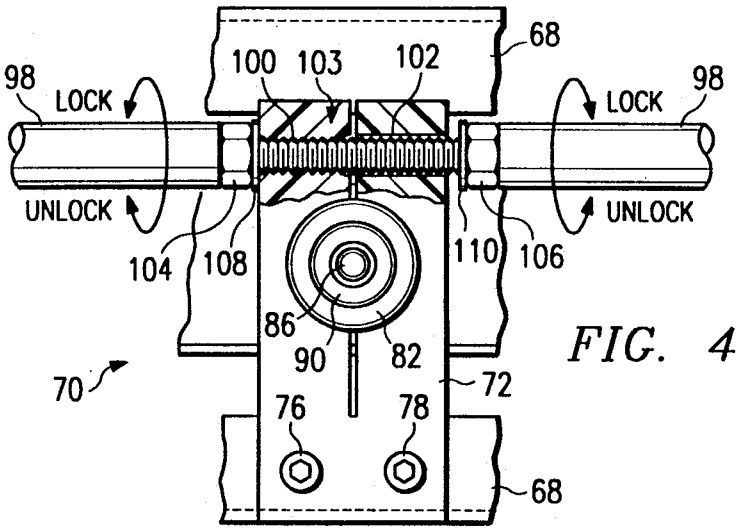
FIG. 4 is a fragmentary plan view of a preferred embodiment of the friction lock mechanism.

As shown most clearly in FIGS. 4 and 5, the tines of top and bottom locking members 72 and 74 are provided with lateral openings through which locking rods 98 pass. Lateral openings of both top and bottom locking members 72 and 74 consist of a tapped portion 100 and a through hole portion 102. Generally, one tine of each locking member 72 and 74 has a tapped hole, while the other tine has a through hole. To effectively engage locking members 72 and 74, locking rod 98 has a threaded portion 103 which passes easily through the through hole section 102, but is constructed to engage tapped section 100. Lock nuts 104 and 106 and washers 108 and 110 are further provided on the outer sides of the tines of locking members 72 and 74. Although FIG. 4 only shows the structure of the portion of friction lock apparatus 70 associated with top control channel 52, the structure of the portion of friction lock apparatus 70 for the bottom control channel 54 is substantially identical.

It should be noted that friction lock apparatus 70 is an optional equipment that provides an extra assurance that gate valve 16 will remain fixed once it is placed in one position or another while the hopper car contents are being discharged. Therefore, it is possible that an operator may find that it is unnecessary to utilize friction lock apparatus 70 for most applications.

Figure 6:
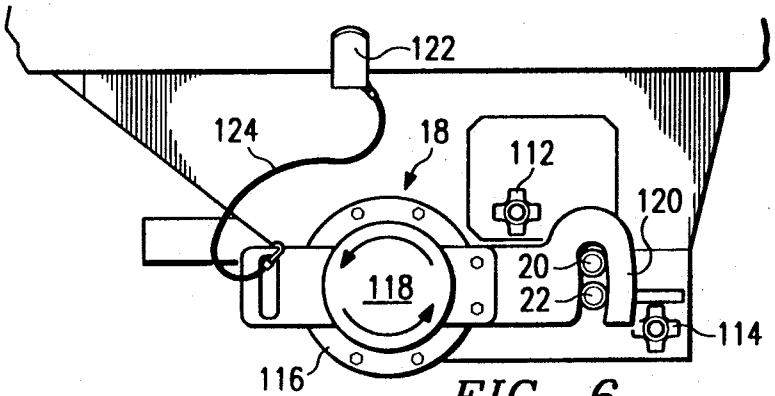
FIG. 6 is an end view of one end of the gate valve.

Referring to FIG. 6, locking rod 98 for locking top control channel 52 in place is further coupled to a lock knob 112 positioned at the outer ends and beyond end plate 65 of gate valve 16 for convenient manipulation by an operator. A corresponding locking rod (not shown) for locking bottom control channel 54 in place is similarly structured and coupled to a corresponding lock knob 114.

Closeable discharge opening 18 can be sealed by a discharge opening cap 116, which has a twist lock mechanism 118 for tightening cap 116. Such twist lock mechanisms are conventional and need not be described in detail herein. Discharge opening cap 116 also has a dual function of maintaining operating levers 20 and 22 in the "closed" position, by engaging a hook-like structure 120 with levers 20 and 22. To prevent misplacing discharge opening cap 116, it is further tethered to a hanger 122 by a cord 124. Hook 120 may also be used to hang cap 116 onto hanger 122.

OPERATION OF THE PREFERRED EMBODIMENT

To load hopper car 10, operating levers 20 and 22 of each gate valve 16 should be visually examined to ensure that they are in the "closed" position, as shown in FIG. 6. Since hopper car 10 as depicted in FIG. 1 has three gate valves 16, each should be inspected to ensure their closed status. The visual examination can be performed from either side of hopper car 10.

To unload the contents of hopper car 10, any or all of the gate valves 16 may be used. To open one of the gate valves 16, discharge opening cap 116 is first removed from discharge opening 18 by actuating twist-lock mechanism 118. Cap 116 may then be hung onto hanger 122. At this time, lock knobs 112 and 114 should be turned either clockwise or counterclockwise, depending on the construction, to deactivate or to ensure disengagement of friction lock apparatus 70.

Referring to FIG. 7*a*, gate valve 16 is at the "closed" position, where valve member 36 is sealed against flow passageway 28. Note that levers 20 and 22 are omitted from FIGS. 7*a*–7*c* to more clearly illustrate the operation of gate valve 16. When operating lever 20 (FIG. 6) is displaced by an operator toward discharge opening 18, top control channel 52 is pivotally displaced likewise, thereby offsetting one end of valve member 36 (depicted as the far side in FIG. 7*b*) from flow passageway 28. The partial opening of gate valve 16 effected in this manner is clearly depicted in FIG. 7*b*. Note that top control channel 52 is pivotally displaced with the pivot point at fastener 86. Note also that the displacement of top control channel 52 may be effected from either side of hopper car 10, where operating lever 20 is moved toward discharge opening 18 on the far side, and moved away from discharge opening 18 on the near side. The extent of the partial opening is controllable by varying the amount of displacement of operating rods 20.

The material in hopper car 10 may be discharged with a partially opened gate valve 16 as seen in FIG. 7*b*. Alternatively, it may be desirable to open gate valve 16 more widely or all the way due to the desired speed of discharge and/or the type of material being discharged. To more fully open gate valve 16, bottom operating lever 22 at the far side is moved away from discharge opening 18 (see FIG. 6), which causes bottom control channel 54 to be pivotally displaced at center pivot point 67, as shown in FIG. 7*c*. The near end of valve member 36 is thus offset from flow passageway 28 and gate valve 16 is opened fully.

Optional friction lock apparatus 70 may be engaged at any time when it becomes desirable to fix the position of gate valve 16. Top control channel position may be fixed by turning lock knob 112, and bottom control channel position may be fixed by turning lock knob 114. Both near and far sides are equipped with lock knobs 112 and 114, so that actuation may be performed at either side. When knob 112 or 114 are rotated, lock nut 104 is forced against the threaded portion 100 of locking member 72, and causes the two tines of locking member 72 to close in on the gap therebetween. This action causes a tightening around locking collar 82, which is affixed to top control channel 52. The friction caused by the tightening locking member 72 around locking collar 82 impedes the rotation at center pivot point 67 and thus prevents top control channel 52 from any further pivotal displacement. The bottom control channel 54 may be fixed in a similar manner by rotating bottom lock knob 114.

To return gate valve 16 to the "closed" position, operating levers 20 and 22 are moved back to the original closed position, after friction lock apparatus 70 is first disengaged. Thereafter, discharge opening 18 may be sealed off by putting cap 116 back on, and its hook 120 properly engaging operating levers 20 and 22, as shown in FIG. 6.

Although the present invention has been described in detail, it should be understood that various changes, substitutions and alterations can be made thereto without departing from the spirit and scope of the present invention as defined by the appended claims.

We claim:

1. A discharge gate valve of a container comprising:

valve body means for connecting to said container and defining a generally elongated discharge opening therefrom;

an elongated valve member having first and second ends, said elongated valve member being slidably moveable and engageable with said elongated discharge opening; and control means coupled to said elongated valve member and having a center pivot for rotating about said center pivot and controllably and pivotally effecting independent displacement of said first and second ends of said elongated valve member with respect to said elongated discharge opening.

2. The gate valve, as set forth in claim 1, wherein said control means further comprises:

a first actuating member having first and second ends and being adapted for pivoting horizontally about said center pivot;

a second actuating member having first and second ends and being adapted for pivoting horizontally about said center pivot;

first connecting means for coupling said first end of said first actuating member to said first end of said valve member;

second connecting means for coupling said second end of said second actuating member to said second end of said valve member; and said first and second actuating members being independently operable for substantially displacing the respective ends of said valve member from said discharge opening.

3. The gate valve, as set forth in claim 2, wherein said control means further comprises means for locking the pivotal displacement of said first and second actuating members.

4. The gate valve, as set forth in claim 3, wherein said locking means includes means for preventing the rotational movement at said center pivot of said first and second actuating members.

5. An hopper car gate valve comprising:

valve body means for connecting to said hopper car and defining a generally elongated discharge opening therefrom;

an elongated valve member having first and second ends, said elongated valve member being slidably moveable and engageable with said elongated discharge opening; and control means coupled to said elongated valve member and having a center pivot for rotating about said center pivot and controllably and pivotally effecting independent displacement of said first and second ends of said elongated valve member with respect to said elongated discharge opening.

6. The hopper car gate valve, as set forth in claim 5, wherein said control means further comprises:

at least one actuating member generally extending longitudinally along said valve member, having a first and second ends, and being adapted for pivoting in a substantially horizontal plane about said center pivot; and end connecting means for coupling said first end of said actuating member to said first end of said valve member.

7. The hopper car gate valve, as set forth in claim 6, further comprising friction lock means for locking said pivotal displacement of said actuating member.

8. The hopper car gate valve, as set forth in claim 7, wherein said friction lock means comprises means for preventing the rotational movement of said actuating member at said center pivot.

9. The hopper car gate valve, as set forth in claim 8, wherein said friction lock means comprises:

a generally cylindrical locking collar affixed to said actuating member concentrically at said center pivot and extending substantially perpendicularly and vertically therefrom; and means for exerting opposing forces around said cylindrical locking collar to prevent it from rotating.

10. The hopper car gate valve, as set forth in claim 9, wherein said force exerting means comprises:

a locking member having at least two fingers joined at a base, said fingers substantially encircling said cylindrical locking collar; and means for selectively clamping said two fingers together and unclamping said fingers.

11. The hopper car gate valve, as set forth in claim 10, wherein said finger clamping means comprises:

said fingers of said locking member having portions generally extending beyond said cylindrical locking collar and defining horizontally aligned holes;

said hole of one of said fingers being threaded;

a locking rod having a threaded portion for engaging said threaded portion of said finger, said locking rod passing through said aligned holes in said fingers and extending longitudinally along said valve member; and stopper means for inhibiting further rotational displacement of said threaded portion of said locking rod along said threaded portion of said finger.

12. The hopper car gate valve, as set forth in claim 6, wherein said control means further comprises:

a second actuating member generally extending longitudinally along said valve member, having first and second ends, and being adapted for pivoting substantially horizontally about said center pivot;

second end connecting means for coupling said second end of said second actuating member to said second end of said valve member; and said actuating members being independently operable for substantially displacing the respective ends of said valve member from said elongated discharge opening.

13. The hopper car gate valve, as set forth in claim 12, wherein each said end connecting means includes a rod extending generally horizontally and perpendicularly with respect to said actuating members and having first and second ends, said first end being pivotally connected to said respective end of said actuating member, said second end being pivotally connected to said respective end of said valve member.

14. The hopper car gate valve, as set forth in claim 12, wherein said control means further includes:

an operating lever coupled to each end of each of said actuating members; and means for confining the range of movement of said operating lever.

15. The hopper car gate valve, as set forth in claim 14, wherein said confining means comprises an end plate defining an horizontal slot for each operating lever through which said operating lever projects.

16. The hopper car gate valve, as set forth in claim 15, wherein operating lever movement as confined by said horizontal slot is operable to substantially displace said respective end of said valve member from said respective end of said elongated discharge opening and to substantially return said respective end of said valve member as to effectively engage and seal said respective end of said elongated discharge opening.

17. The hopper car gate valve, as set forth in claim 12, further comprising friction lock means for locking said pivotal displacement of both said actuating members.

18. The hopper car gate valve, as set forth in claim 5, further comprising friction lock means for locking said displacement of said valve member from said elongated discharge opening.

19. Apparatus for controlling a hopper gate valve adapted for closing off an elongated hopper car discharge opening, comprising:

a first actuating member having first and second ends being adapted for pivoting horizontally about a first center pivot;

a second actuating member having first and second ends being adapted for pivoting horizontally about a second center pivot;

first connecting means for coupling said first end of said first actuating member to one end of said hopper gate valve;

second connecting means for coupling said second end of said second actuating member to another end of said hopper gate valve; and said first and second actuating members being independently operable for substantially displacing the respective ends of said hopper gate valve from said discharge opening.

20. The apparatus, as set forth in claim 19, wherein said first and second actuating members are independently operable from either of its respective first and second ends.

21. The apparatus, as set forth in claim 19, further comprising locking means for maintaining the displacement of said first and second actuating members.

22. The apparatus, as set forth in claim 21, wherein said locking means comprises:

a generally cylindrical locking collar affixed to each said actuating member concentrically at said center pivot and extending substantially perpendicularly and vertically therefrom; and means for exerting opposing forces around said cylindrical locking collar to prevent it from rotating.

23. The apparatus, as set forth in claim 22, wherein said force exerting means comprises:

a locking member having at least two fingers joined at a base, said fingers substantially encircling said cylindrical locking collar; and means for selectively clamping said two fingers together and unclamping said fingers.

* * * * *